US007516619B2

(12) United States Patent
Pelletier

(10) Patent No.: US 7,516,619 B2
(45) Date of Patent: Apr. 14, 2009

(54) EFFICIENT CONVERSION OF HEAT TO USEFUL ENERGY

(75) Inventor: Richard I. Pelletier, Livermore, CA (US)

(73) Assignee: Recurrent Engineering, LLC, Kennett Square, PA (US)

( * ) Notice: Subject to any disclaimer, the term of this patent is extended or adjusted under 35 U.S.C. 154(b) by 422 days.

(21) Appl. No.: 11/182,603

(22) Filed: Jul. 14, 2005

(65) Prior Publication Data

US 2006/0010870 A1 Jan. 19, 2006

(51) Int. Cl.
*F01K 25/06* (2006.01)

(52) U.S. Cl. ..... 60/649; 60/651; 60/671

(58) Field of Classification Search ..... 60/649, 60/651, 671

See application file for complete search history.

(56) References Cited

U.S. PATENT DOCUMENTS 4,330,084 A * 5/1982 Buchner et al. ..... 237/12.1
4,586,340 A 5/1986 Kalina
4,604,867 A * 8/1986 Kalina ..... 60/653
4,763,480 A 8/1988 Kalina
4,982,568 A 1/1991 Kalina
5,095,708 A 3/1992 Kalina
5,132,076 A * 7/1992 Corpora et al. ..... 376/310
5,291,530 A * 3/1994 Impink et al. ..... 376/219
5,572,871 A 11/1996 Kalina
5,649,426 A 7/1997 Kalina et al.
5,950,433 A * 9/1999 Kalina ..... 60/649
6,910,334 B2 * 6/2005 Kalina ..... 60/651
6,968,690 B2 * 11/2005 Kalina ..... 60/649

* cited by examiner

*Primary Examiner*—Hoang M Nguyen
(74) *Attorney, Agent, or Firm*—Workman Nydegger

(57) ABSTRACT

A heat transfer system includes a power sub-system configured to receive a heat source stream, and one or more heat exchangers configured to transfer heat from the heat source stream to a working stream. The working stream is ultimately heated to a point where it can be passed through one or more turbines, to generate power, while the heat source stream is cooled to a low temperature tail. A distillation condensation sub-system cools the spent stream to generate an intermediate stream and a working stream. The working stream can be variably heated by the intermediate stream so that it is at a sufficient temperature to make efficient use of the low temperature tail. The working stream is then heated by the low temperature tail, and subsequently passed on for use in the power sub-system.

17 Claims, 2 Drawing Sheets

EFFICIENT CONVERSION OF HEAT TO USEFUL ENERGY

CROSS-REFERENCE TO RELATED APPLICATIONS

This application claims priority to and the benefit of Australian Provisional Patent Application No. 2004903961, filed on Jul. 19, 2004, entitled "METHOD FOR CONVERTING HEAT TO USEFUL ENERGY"; and also claims priority to and the benefit of Australian Application No. 2005203045, filed on Jul. 13, 2005, entitled "METHOD FOR CONVERTING HEAT TO USEFUL ENERGY", the entire specifications of both applications are incorporated herein by reference.

BACKGROUND OF THE INVENTION

1. The Field of the Invention

The present invention relates to systems, methods and apparatus configured to implement a thermodynamic cycle via countercurrent heat exchange. In particular, the present invention relates to generating electricity by heating a multi-component stream with a heat source stream at one or more points in a thermodynamic cycle.

2. Background and Relevant Art

Some conventional heat transfer systems allow heat that would otherwise be wasted to be turned into useful energy. One example of a conventional heat transfer system is one which converts thermal energy from a geothermal hot water or industrial waste heat source into electricity using a counter current heat exchange technology. For example, the heat from relatively hot liquids in a geothermal vent (e.g., "brine") can be used to heat a multi-component fluid in a closed system (a "fluid stream"), using one or more heat exchangers. The multi-component fluid is heated from a low energy and low temperature fluid state into a relatively high-pressure gas ("working stream"). The high-pressure gas, or working stream, can then be passed through one or more turbines, causing the one or more turbines to spin and generate electricity.

Accordingly, conventional heat transfer systems operate on the general counter current heat exchange principles to heat the multi-component working fluid through a variety of temperature ranges, from relatively cold to relatively hot. A conventional fluid stream for such a system comprises different fluid components that each have a different boiling point. Thus, one component of the fluid stream may become a gas at one temperature point, while another fluid stream component may remain in a relatively hot liquid state at the same temperature. This can be useful for separating the different components at different points in the closed system. Nevertheless, all, or nearly all, of the components of the fluid stream can be raised to a temperature such that all components of the fluid stream collectively comprise a "working stream", or high pressure gas.

To accomplish heating of the fluid between the fluid stream and the working stream, the heat transfer system comprises apparatus configured primarily to cool the working stream to a cooler temperature, or heat the fluid stream to a hotter temperature. For example, the fluid stream passes through one or more heat exchangers that couple the fluid stream to the heat source stream as the fluid stream progresses toward a high temperature state, which is then passed through the one or more turbines. By contrast, the working stream that has already passed through the turbines is typically referred to as a spent stream. The spent stream is cooled by transferring heat to the fluid stream in a heat exchanger, since the spent stream is relatively hotter than the fluid stream at one or more stages in the system.

In order to achieve the temperature requirements for expansion in the turbines, countercurrent heat exchange systems heat the fluid stream from lower temperature points to the higher temperature points. This results in a number of system variables that conventional heat exchange systems will take into account. For example, if the optimal expansion temperature of an ambient temperature multi-component stream is a vapor working stream of a very high temperature, a very hot heat source that is typically much hotter than the desired temperature of the working stream will be utilized. Alternatively, if the heat source is only somewhat hotter than the ultimate desired temperature of the multi-component stream, the fluid stream will likely need to be warmer than ambient temperature, so that the multi-component fluid can be heated to the desired working stream temperature.

At least in part, due to this distinction in fluid stream starting temperatures, temperatures of the heat source, desired temperature of the working stream, and efficiencies of the system the heat source brine is usually discarded at a temperature that is much hotter than desired. For example, in some illustrative systems as conventional heat transfer systems pass the brine through one or more heat exchangers, the brine is cooled from an average temperature of about 600° F. to a throw-away temperature of about 170-200° F. While 200° F. is still a relatively hot temperature to perform meaningful heat transfers on conventional fluid streams, the conventional fluid stream is considered relatively cool, or lukewarm, at a similar temperature of about 170-200° F. In particular, the coolest point of a conventional fluid stream is usually too warm to be heated in any efficient way by the low temperature portion (i.e., the "low temperature tail") of the brine. As such, conventional heat systems tend to be more efficient by discarding the brine at approximately 170-200° F.

One possible solution could be to cool the fluid stream to temperature that is much lower than 190-200° F., so that the fluid stream can be efficiently heated using the heat of the low temperature tail. In principle, this might involve the use of a Distillation Condensation Sub-system ("DCSS") in conjunction with the above-described heat transfer system. Unfortunately, while use of a DCSS could efficiently cool a spent stream, the temperature to which the conventional DCSS would cool a typical spent stream would ordinarily be too low to be efficiently utilized. That is, the conventional DCSS would cool the spent stream to a temperature that is so low that it could not be efficiently raised to a high enough temperature later on as a working stream.

Accordingly, an advantage in the art can be realized with systems and apparatus that allow efficient use of a low temperature tail. In particular, an advantage in the art can be realized with heat transfer systems that are able to efficiently use a DCSS, so that a fluid stream can still be raised to an efficient working stream temperature.

BRIEF SUMMARY OF THE INVENTION

The present invention solves one or more of the foregoing problems in the prior art with systems and apparatus configured to efficiently use more waste heat than possible in prior heat transfer systems. In particular, the present invention provides for the use of a "low temperature tail" of a brine heat source in a heat transfer system, at least in part by efficiently incorporating a DCSS along with additional heat exchange apparatus.

For example, in one embodiment of the present invention, a DCSS is coupled to a counter current heat exchange system. The DCSS is used at least in part to cool a spent working stream after the working stream has been passed through one or more turbines. Due to the relatively cool temperature of the fluid stream provided by the DCSS, however, one or more heat exchange apparatus are added to increase the temperature of the fluid stream to a useful temperature range. At this temperature range, the fluid stream can subsequently be coupled to a low temperature tail as low as 150-200° F. via an additional heat exchanger, and still ultimately reach an appropriate working stream temperature.

Accordingly, a heat transfer system in accordance with the present invention can convert a greater amount of heat from the heat source into useful energy, and can do so with significantly more energy efficiency than prior heat transfer systems.

Additional features and advantages of exemplary embodiments of the invention will be set forth in the description which follows, and in part will be obvious from the description, or may be learned by the practice of such exemplary embodiments. The features and advantages of such embodiments may be realized and obtained by means of the instruments and combinations particularly pointed out in the appended claims. These and other features will become more fully apparent from the following description and appended claims, or may be learned by the practice of such exemplary implementations as set forth hereinafter.

BRIEF DESCRIPTION OF THE DRAWINGS

In order to describe the manner in which the above-recited and other advantages and features of the invention can be obtained, a more particular description of the invention briefly described above will be rendered by reference to specific embodiments thereof which are illustrated in the appended drawings. Understanding that these drawings depict only typical embodiments of the invention and are not therefore to be considered to be limiting of its scope, the invention will be described and explained with additional specificity and detail through the use of the accompanying drawings in which.

DETAILED DESCRIPTION OF THE PREFERRED EMBODIMENTS

The present invention extends to systems and apparatus configured to efficiently use more waste heat than possible in prior heat transfer systems. In particular, the present invention provides for the use of a "low temperature tail" of a brine heat source in a heat transfer system, at least in part by efficiently incorporating a DCSS along with additional heat exchange apparatus.

Figure 1:
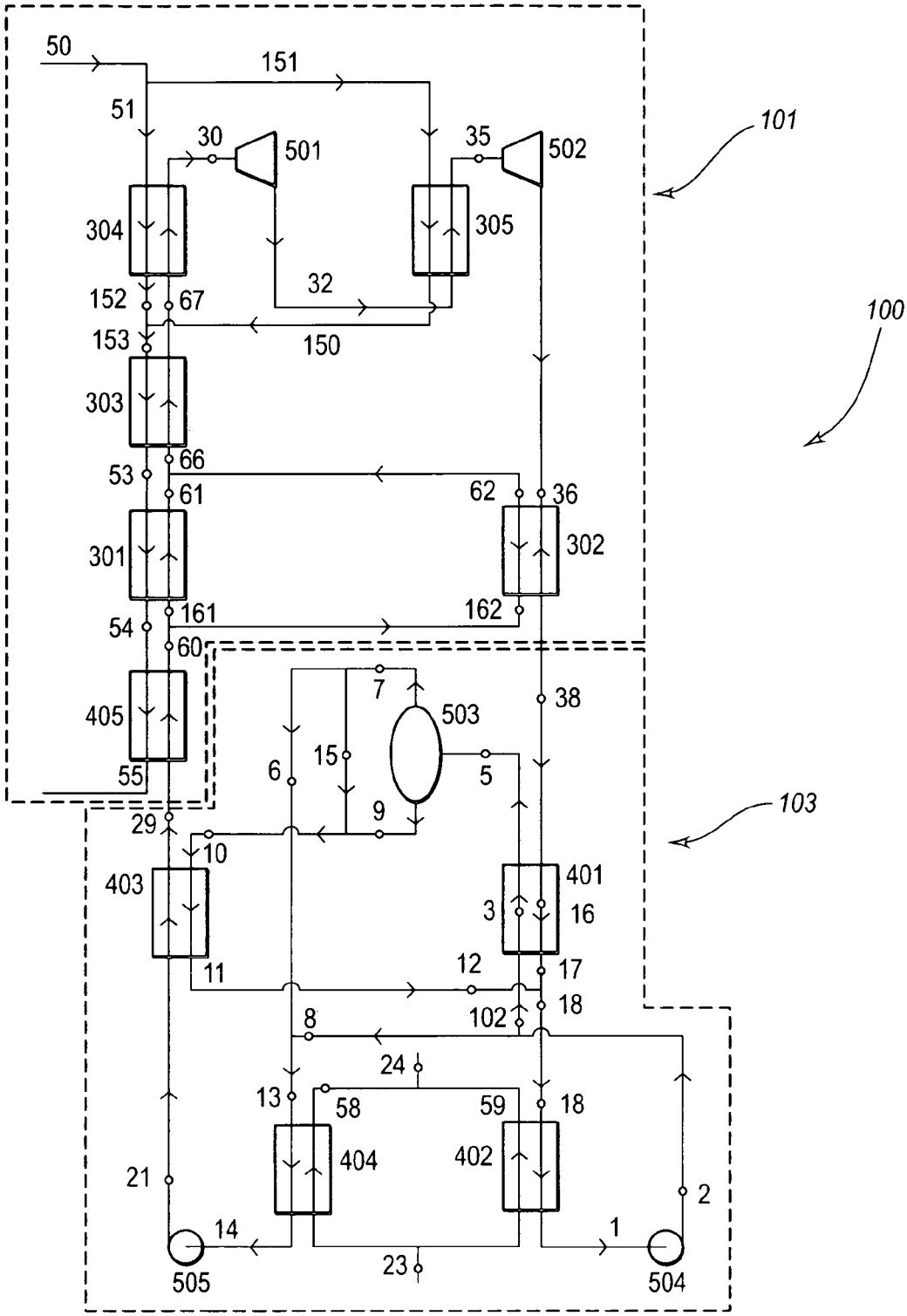
FIG. 1 illustrates a heat transfer system in accordance with an embodiment of the present invention, in which two turbines are used.

For example, FIG. 1 illustrates one embodiment of the present invention in which a heat transfer system 100 comprises a power sub-system 101 that is coupled to a cooling system, such as Distillation Condensation Sub-system ("DCSS") 103. The power sub-system 101 can be thought of generally as heating the multi-component stream to a point at which the fluid multi-component stream becomes an at least partially a vapor working stream. By contrast, the DCSS 103 can be thought of generally as cooling a post expansion spent stream to a cooled fluid stream, as well as heating the fluid stream where appropriate for later use as a multi-component stream in the power sub-system 101. FIG. 1 also shows the direction of a multi-component stream (both for the fluid stream and for the heat source stream) throughout the heat transfer system 100, as the fluid is condensed and heated in heat exchangers in the system.

Accordingly, the following description outlines the stream of a heat source stream (e.g., "brine") as it streams through the heat transfer system 100 (and system 200), and then the flow of spent and intermediate fluid streams, which are distinct and separate from the heat source stream, through the power sub-system 101 and the DCSS 103. With reference to the heat source stream, it will be understood that there can be many types of heat source streams that can be implemented with the present invention. For example, a heat source stream that is suitable for use with the present invention can comprise any suitably hot liquid or vapor, or mixture thereof, such as naturally or synthetically produced liquids, steams, oils, and so forth. Accordingly, implementations of the systems described herein can be particularly useful for converting heat from geothermal fluids, such as "brine", into electric power, as well as converting other synthetic fluid waste heat in a factory environment into electric power.

Referring again to FIG. 1, the heat source stream enters the heat transfer system 100 at point 50 (anywhere from 250° F. to 800° F.), whereupon the heat source splits into two streams 51 and 151, which are used to add heat to a working stream just before the working stream passes to a turbine or other expansion component. For example, stream 51 passes through heat exchanger 304, which transfers heat to the working stream at point 30 just before passing into a first turbine 501. As described herein, the splitting of streams can be carried out by any suitable means, such as a conventional splitting component that splits the multi-component stream into two separate streams.

After the working stream passes the first turbine, the working stream cools somewhat to a point 32. Accordingly, stream 151 heats the working stream from point to point 35 when it passes through heat exchanger 305, which is adjacent a second turbine 502, such that the working stream can be heated just before it passes into the second turbine 502. As used herein, a "heat exchanger" may be any conventional type of heat exchanger, such as conventional shell and tube, or plate-type heat exchangers, or variations or combinations thereof. Accordingly, the heat source stream at point 151 cools to parameters at point 150, having transferred an amount of its heat in heat exchanger 305.

Streams 150 (original stream 151) and 152 (original stream 51) are then combined at point 153 prior to entering heat exchanger 303, wherein the combined stream at point 153 is an amount cooler than at point 50. The mixing or combining of any working, intermediate, spent, or otherwise fluid stream may be carried out by any suitable mixing device to combine the streams to form a single stream.

Having passed heat exchangers at point 153, the combined heat source stream is still at a relatively high temperature, and so still has a significant amount of heat that can be transferred to the working stream. As such, the combined stream at point 153 is passed through heat exchanger 303, thereby transferring the heat from the heat source stream to the working stream, causing the working stream to heat from points 66 to 67. The heat source stream, having somewhat cooler parameters at point 53, is still at a relatively high temperature, and so is passed through heat exchanger 301. This heats the working stream from point 161 to 61, and cools the heat source stream further from point 53 to point 54.

In one embodiment, at point 54, these parameters of the heat source stream are associated with a temperature range of about 170-200° F., depending in part on other operating conditions of the relevant heat source and system 101. In another embodiment, the parameters of the heat source stream at point 54 are associated with a temperature ranges of about 130-250° F. At point 54, the heat source stream is now at parameters of the conventional "low temperature tail", and would ordinarily be discarded. As will be understood more fully from the following description, however, system 100 can efficiently use this low temperature tail, such that the heat source stream is passed from point 54 through heat exchanger 405 to point 55. Since heat exchanger 405 transfers heat from the low temperature tail, the heat exchanger 405 can be termed a "residual heat exchanger".

Having described the path of the heat source stream, the following description illustrates the path and changes to the fluid stream of the system 100, as it is heated and cooled in various stages through the power sub-system 101 from point 60 to point 36, and then as it travels through the DCSS 103 from point 38 to point 29. By way of explanation, in one embodiment the fluid stream can comprise a water-ammonia mixture that has a boiling point of approximately 196° F., and a dew point at approximately 338° F. As will be understood from the present description, therefore, the fluid stream is at or near its boiling pint at point 60, at or near its dew point at point 30, and at or near liquid forms at points 18, and 102. These differences between boiling point, dew point, and liquid form occur since the working fluid comprises a mixture of components, rather than one pure substance.

With reference to FIG. 1 at point 60, the heat transfer system 100 splits the working stream into two multi-component streams at points 161 and 162. The working stream at point 161 is heated by the heat source stream to parameters at point 61 in heat exchanger 301, while the working stream at point 161 is heated to parameters of point 62 by the spent stream 36 at heat exchanger 302. After passing through the relevant heat exchangers, the working streams at points 61 and 62 are then combined into a working stream that has parameters at point 66. Since part of the working stream at point 60 is heated by the heat source stream, while another part of the working stream is heated by the spent stream, the power sub-system 101 can make efficient use of a number of potential heat sources.

The working stream at point 66 is heated by the heat source stream from point 153 to parameters at point 67 via heat exchanger 303. In one embodiment, at point 67 the working stream begins to be converted toward a superheated vapor. Thereafter, the working stream is heated by the heat source stream at point 51, such that the working stream heats from point 67 to point 30 via heat exchanger 304. This optimizes the conventional working stream so that it can pass through the turbine 501 at a desired high energy state. In one embodiment, the desired high energy state is a superheated vapor.

As the working stream passes through the turbine 501, from points 30 to 32, the working stream becomes at least "partially spent", such that it loses an amount of energy in the form of lost pressure and temperature. The partially spent stream at point 32 is heated through a heat exchanger 305 to obtain parameters of point 35. As such, one will appreciate that the system 100 may find additional incremental energy gains by continuing to split the heat source stream at point 50 to heat still subsequent iterations of a partially spent working stream through still further numbers of heat exchangers and turbines, and so on. As such, the use of one or two turbines of the present disclosure are merely exemplary of one suitable embodiment.

After passing the working stream through the one or more turbines 501, 502, the now spent stream at point 36 is passed through a heat exchanger 302. This cools the spent stream to the parameters of point 38, while at the same time heating a part of the working stream from point 162 to 62. (In at least some cases, the spent stream at point 36 may be at a lower pressure than the high pressure working stream at points 162 and 62, even though the spent working stream at point 36 is hotter.) In conventional systems, the spent stream at point 38 would ordinarily be passed to point 60 for recuperative reheating. In the present system 100, however, the spent stream at point 38 is cooled further using a DCSS 103.

For example, the spent stream at point 38 is passed through heat exchanger 401, such that the spent stream is cooled from point 38 to parameters at points 16, and then 17. This cooling of the spent stream from point 38 to point 17 in heat exchanger 401 transfers heat to the relatively cooler intermediate "lean stream" from point 102 to point 5. The lean stream passes from relatively cooler parameters of point 102 to relatively hotter parameters at point 3 (typically a boiling point), and ultimately to parameters at point 5. In general, a "lean stream" refers to a fluid stream having less of a lower boiling point component than a higher boiling point component (e.g. ammonia versus water), while a "rich stream" refers to a fluid stream having more of a lower boiling point component than a higher boiling point component. Furthermore, an "intermediate lean" stream has more of a lower boiling point component (e.g., ammonia, in an ammonia/water composition) than a "lean" or "very lean" stream (i.e., least amount of ammonia, in an ammonia/water composition), but less lower boiling point component than a "rich" stream.

The spent stream at point 17 then combines with a very lean stream that has parameters of point 12, to produce a combined fluid stream (or "intermediate lean stream") that has parameters of point 18. The combined, intermediate lean stream is then cooled at heat exchanger 402, which transfers heat from the intermediate lean stream at point 18 to a cooling medium. Apparatus 402 and 404 may comprise any suitable heat exchange condensers, such as water or air-cooled heat exchangers.

The cooling medium can be any number or combination of media sufficient to condense the intermediate lean stream from point 18 to point 1 through the heat exchanger 402. Such media can include air, water, a chemical coolant, and so forth, and are simply cycled in and out of the system 100, as appropriate. As such, the cooling medium is introduced to the system 100 relatively cool, such of point 23, heated by heat exchangers 402 and 404 to points 59 and 58, and then cycled out of the system 100 relatively warm at point 24. Since the cooling medium is cycled in and out of the system, the cooling medium maintains a relatively constant, cool temperature that can absorb heat from the multi-component stream.

After the intermediate lean stream has been condensed to parameters at point 1, pump 504 elevates the pressure of the stream, causing the intermediate lean stream to be elevated to parameters of point 2. Thereafter, the elevated pressure intermediate lean stream is then split into two parts. One part, which will be discussed in further detail subsequently, has parameters of point 8, and is mixed with a rich stream having parameters of point 6. The other part of the medium pressure intermediate lean stream, having parameters of point 102, is heated in apparatus 401 by the spent stream of point 6, such that the intermediate lean stream gains parameters of point 5.

At point 5, the intermediate lean stream is separated in apparatus 503 into primarily vapor and liquid components, such that the vapor component has parameters of point 7, and the liquid component has parameters of point 9. One will appreciate, however, that neither the vapor nor the liquid components are purely one component or another. Nevertheless, the vapor stream will be richer in the lower boiling component (i.e., a "rich" stream); while the liquid stream have a greater amount of higher boiling point component (i.e., a "lean" stream). Apparatus 503 can comprise any suitable separator or distilling device that is known in the art, such as a gravity separator (e.g., a conventional flash tank).

In one embodiment, the vapor and liquid components of the streams at points 7 and 9 are separated so that they can be selectively mixed (or not mixed) to heat (or maintain) the amount of temperature provided at an intermediate heat exchanger 403. For example, a portion of the vapor at point 7 can be selectively split into one stream at point 6, and another stream at point 15. If the liquid component at point 9 is not hot enough to heat the multi-component stream from point 21 to point 29 in the heat exchanger 403, a greater portion of the hotter vapor component stream from point 15 may be added to the liquid component stream at point 9, to produce a hotter stream having parameters at point 10. Alternatively, if the liquid component at point 9 is hot enough for what is needed in heat exchanger 403, then no mixing with the vapor at point 15 will be needed. Such mixing, therefore, is optional and depends on the relevant operating conditions.

Regardless of whether such mixing is done, the stream at point 10 is generally a "very lean" stream, or a stream with a relatively low amount of low boiling point component. This very lean stream at point 10 passes through the intermediate heat exchanger 403, heats the fluid stream of point 21, and cools the very lean stream from point 10 to point 11. In some cases, if necessary, the fluid stream at point 11 may further be throttled to a lower pressure. Nevertheless, the fluid stream of point 11 passes to parameters of point 12, and then mixes with the spent stream at point 17 before passing through heat exchanger 402.

Referring back to the stream at point 5, the vapor component at point 7 that is split apart from the liquid component of point 9, differs from the vapor components of points 6 and 15 primarily with respect to stream rate. In practice, however, the vapor components of points 6, 7, and 15 may also have slightly different pressures. Regardless, the vapor component (i.e., the component at point 7, or component streams 6, or 15), is a "rich" stream, having a relatively high amount of low-boiling-point component. This "rich" stream at point 6 is subsequently mixed with the portion of the intermediate lean stream at point 8, to produce the multi-component stream at point 13. The intermediate stream at point 13 is approximately the same proportion of low and high boiling point components (e.g., proportion of ammonia to water) as the working stream used subsequently in the heat transfer process, such of points 60 and higher.

This intermediate stream at point 13 is then condensed at the heat exchanger 404 by the afore-described cooling medium and becomes a condensed stream. As such, this fluid stream at point 13 cools from parameters of point 13 to parameters of point 14. The fluid stream at point 14 is then pumped through pump 505, such that the fluid stream becomes a high-pressure working stream that has parameters of point 21. The working stream at point 21 is then heated to point 29 through the heat exchanger 403, causing the intermediate stream to cool from point 10 to point 11. At point 29, the working stream is heated by the "low temperature tail" of the heat source stream at heat exchanger 405, such that the heat source stream cools from points 54 to 55.

In view of the foregoing, one will appreciate that the working stream at point 29 should be at an appropriate temperature that it can make efficient use (i.e., be heated by) of the low temperature tail in heat exchanger 405. This can help ensure that the working stream at point 30 passes through the turbine 501 at the highest available energy for the system 100. Accordingly, whether the working stream at point 30 reaches its most efficient energy output can depend in part on the temperature of the intermediate stream is at point 10. For example, if the working stream at point 29 is at too high of a temperature, there is little or no efficiency added transferring heat from the low temperature tail at points 54 to 55. By contrast, if the working stream at point 29 is too cool after passing through the DCSS 103, the low temperature tail from points 54-55 will not be able to heat the working stream from point 29 all the way to the desired temperature at point 60.

According to one embodiment of the present invention, the DCSS 103 can help ensure the appropriate temperature of the working stream at point 29 by allowing for the variable addition of heat to the intermediate stream at point 10. As previously described, this can be accomplished by variably adding (or not adding) vapor component 15 with liquid component 9. In other words, the more of vapor 15 that is added to stream 9, the hotter the mixed fluid stream is at point 10, and the more heat that can be added to the working stream at point 21. Therefore, the provisions for separating and mixing of the fluid stream in the DCSS 103 allows the system 100 to make efficient use of the low temperature tail (i.e., points 54-55) in the working stream. Furthermore, implementations of the present invention make effective use of the low heat source stream for additional power at turbines 501 and 502, and so on.

Figure 2:
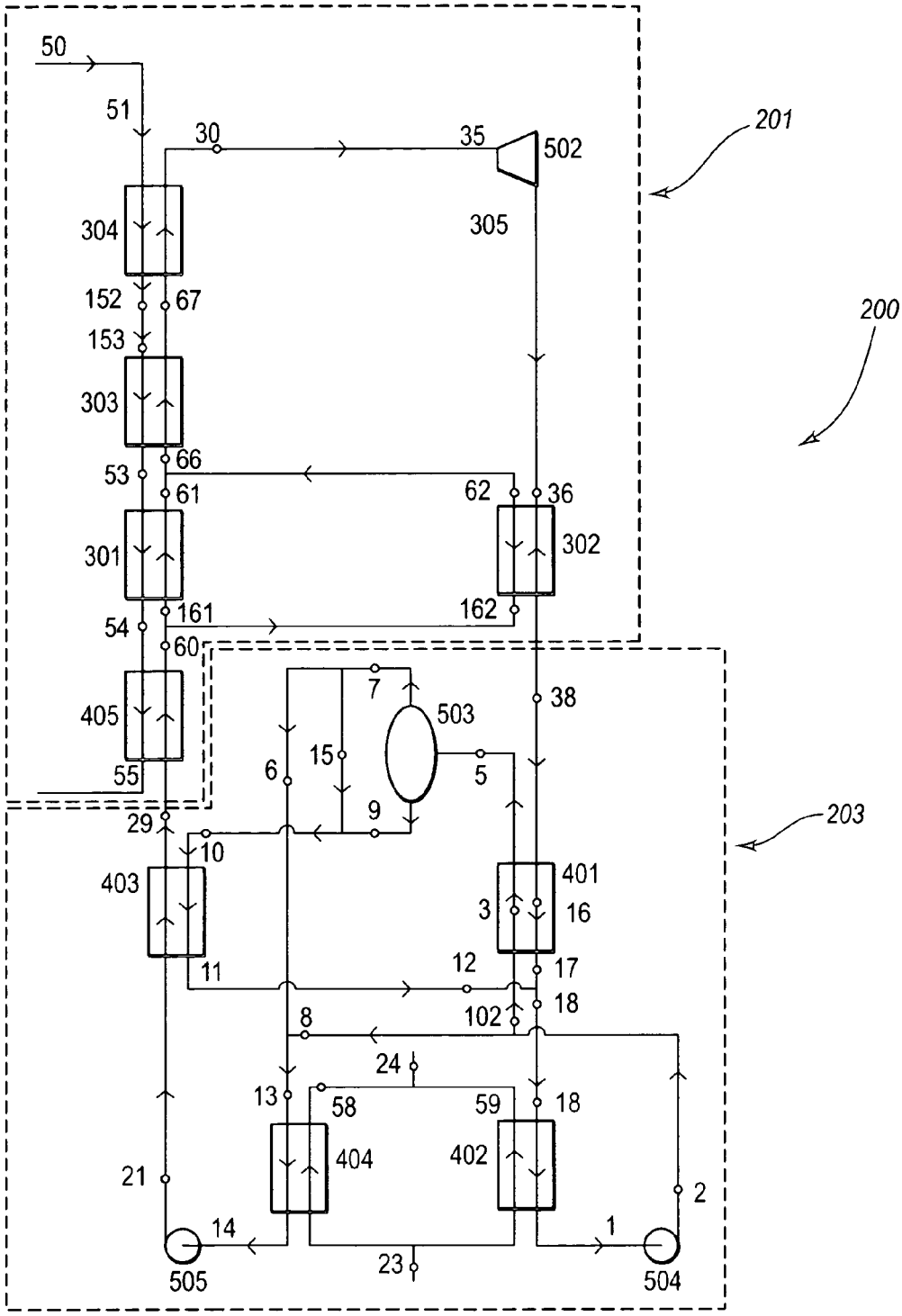
FIG. 2 illustrates a heat transfer system in accordance with another embodiment of the present invention, in which one turbine is used.
Figure 1:
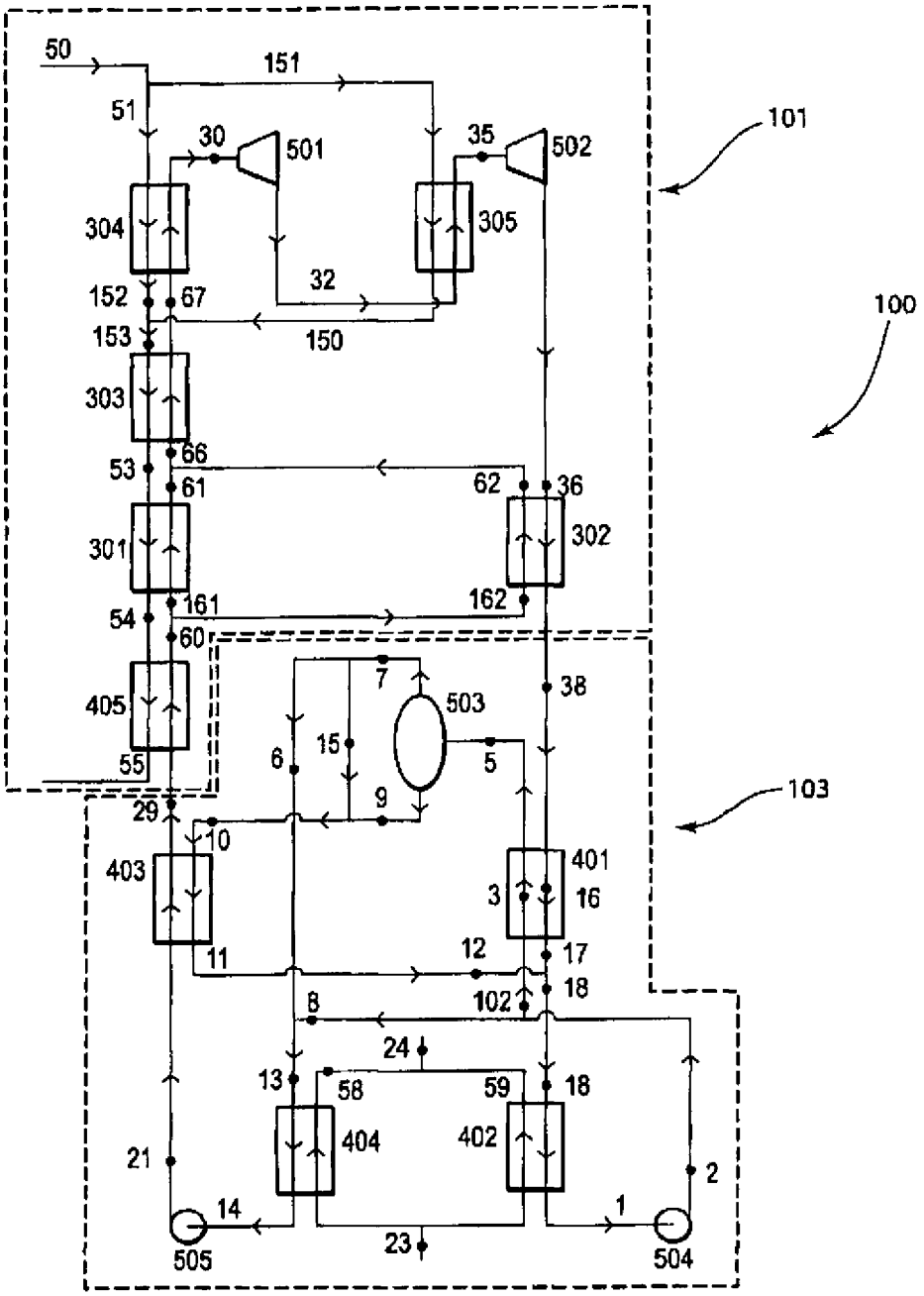
Figure 2:
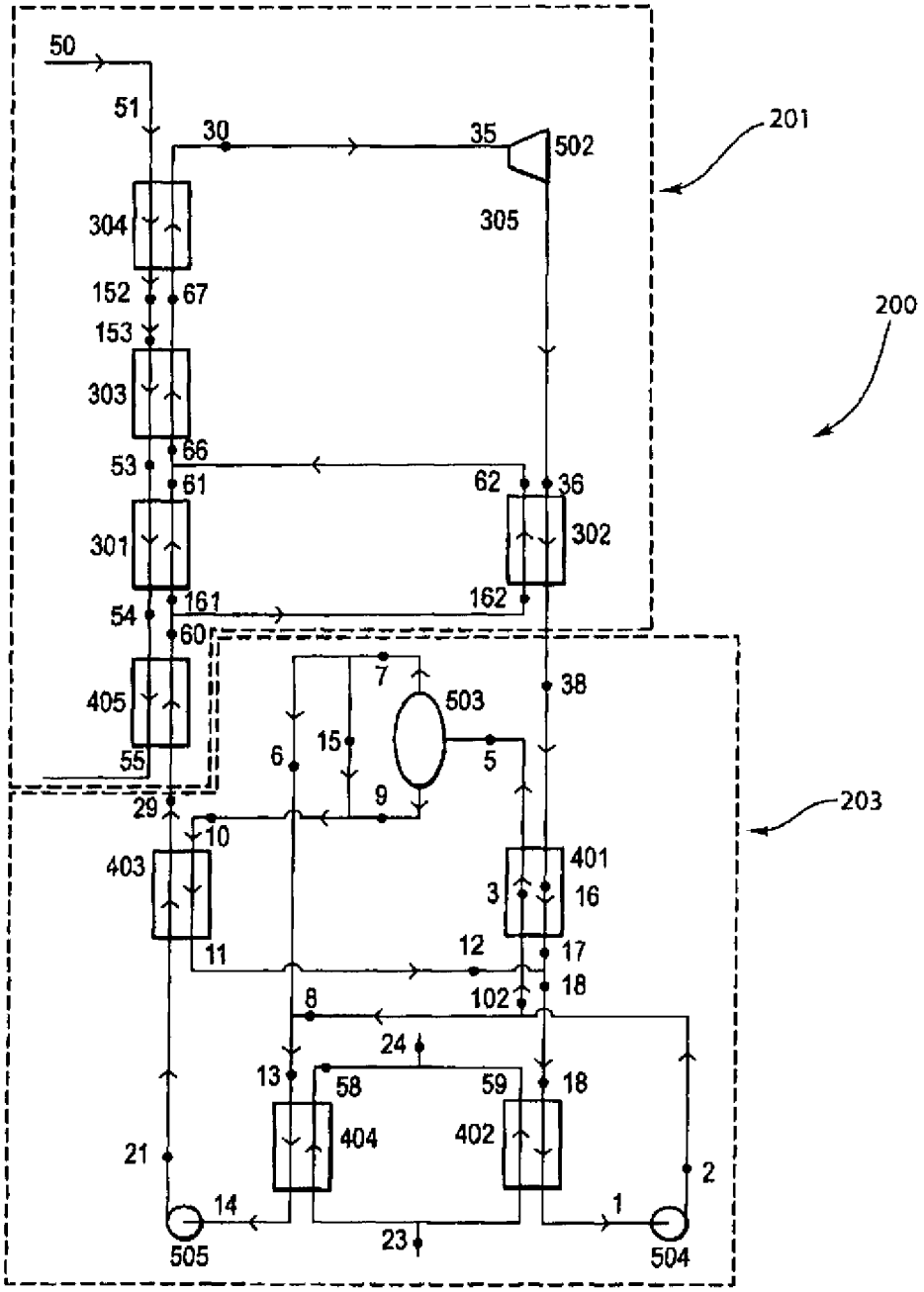

FIG. 2 shows an alternative heat transfer system 200, which implements only a single turbine 502. In particular, system 100 can be modified, as shown in FIG. 2, so that streams 32, 150, and 151, and heat exchanger 305 are omitted. This results in only the working stream at point 30 passing through turbine 502 to produce a spent stream 36, which is then processed in heat exchanger 302, as described above. As mentioned above, however, the number of turbines that can be used for incremental energy gains may be varied within the context of the present invention.

In alternative embodiments of the present invention, whether system 100 or 200, heat exchanger 303 may be dispensed with, in lieu of heat exchanger 304. In another alternative embodiment, heat exchanger 302 may be dispensed with in lieu of heat exchanger 301.

The present invention may be embodied in other specific forms without departing from its spirit or essential characteristics. The described embodiments are to be considered in all respects only as illustrative and not restrictive. The scope of the invention is, therefore, indicated by the appended claims rather than by the foregoing description. All changes that come within the meaning and range of equivalency of the claims are to be embraced within their scope.

I claim:

1. A heat transfer system for converting heat into energy, comprising:

a power sub-system communicatively coupled to a heat source stream, said power sub-system comprising:

a first heat exchanger adapted to heat a multi-component working stream with heat from said heat source stream thereby producing a heated working stream;

a turbine adapted to expand said heated working stream thereby producing a spent stream;

a stream splitter adapted to split a partially heated working stream into a first substream and a second substream prior to being heated in said first heat exchanger, and a second heat exchanger adapted to heat said first substream with heat from said spent stream thereby producing a cooled spent stream having a first set of thermodynamic characteristics;

a distillation condensation sub-system adapted to receive said cooled spent stream having substantially the same thermodynamic characteristics as said first set of thermodynamic characteristics, thereby producing a condensed working stream; and a residual heat exchanger adapted to heat said condensed working stream with heat from a low temperature tail of said heat source stream thereby producing said partially heated working stream.

2. The heat transfer system as recited in claim 1, wherein said working stream comprises a mixture of components that each have a different boiling point.

3. The heat transfer system as recited in claim 1, wherein said heat source stream is a fluid material comprising brine arising from a geothermal vent.

4. The heat transfer system as recited in claim 1, wherein said distillation condensation sub-system further comprises a separator configured to substantially separate a vapor component of an intermediate stream from a liquid component.

5. The heat transfer system as recited in claim 4, wherein said distillation condensation sub-system is configured to optionally recombine said vapor component with the said liquid component in order to obtain an appropriate temperature for said intermediate stream.

6. The heat transfer system as recited in claim 5, wherein said distillation condensation sub-system further comprises a heat exchanger that transfers heat from said intermediate stream to said working stream after said intermediate stream has passed said separator, such that said intermediate stream heats said working stream to a temperature that is appropriate for use with said low temperature tail.

7. The heat transfer system as recited in claim 1, wherein said power sub-system comprises a second turbine configured to generate electricity from said working stream.

8. A method for implementing a thermodynamic cycle comprising:

expanding a multi-component gaseous working stream transforming its energy into a usable form and producing a spent stream;

cooling the spent stream producing a cooled spent stream having a first set of thermodynamic characteristics;

condensing the cooled spent stream having substantially the same thermodynamic characteristics as said first set of thermodynamic characteristics in a distillation condensation sub-system and producing a condensed stream;

pressurizing the condensed stream and producing a multi-component stream;

heating the multi-component stream with fluid from the distillation condensation subsystem;

subsequent to heating the multi-component stream with fluid from the distillation condensation subsystem, heating the working stream with the low temperature tail of a heat source stream at a residual heat exchanger;

splitting the multi-component stream heated at the residual heat exchanger to form a first substream and a second substream;

heating the first substream with heat from the spent stream at a first heat exchanger, thereby forming said cooled spent stream;

recombining the first substream and the second substream to form a recombined multi-component stream; and heating the recombined multi-component stream with heat from the heat source stream at a second heat exchanger to form the multi-component gaseous working stream.

9. The method as recited in claim 8, further comprising heating the second substream with heat from the heat source stream.

10. The method as recited in claim 9, wherein the second substream is heated in a third heat exchanger.

11. The heat transfer system as recited in claim 1, further comprising a second heat exchanger communicatively coupled to heat the second substream with heat from the heat source stream.

12. The heat transfer system as recited in claim 1, wherein the second substream is heated by heat from the heat source stream.

13. A method for implementing a thermodynamic cycle comprising:

expanding a multi-component gaseous working stream transforming its energy into a usable form and producing a spent stream;

cooling the spent stream and producing a cooled spent stream having a first set of thermodynamic characteristics;

condensing the cooled spent stream having substantially the same thermodynamic characteristics as said first set of thermodynamic characteristics in a distillation condensation sub-system and producing a condensed stream;

pressurizing the condensed stream and producing a multi-component stream;

heating the multi-component stream with the low temperature tail of a heat source stream at a residual heat exchanger;

splitting the multi-component stream heated at the residual heat exchanger to form a first substream and a second substream;

heating the first substream with heat from the spent stream at a first heat exchanger, thereby producing the cooled spent stream; and heating the second substream with heat from the heat source stream at a second heat exchanger.

14. The method of claim 13, wherein the working stream has a temperature at or near its boiling point after being heated with the low temperature tail of the heat source stream.

15. The method of claim 13, wherein the distillation condensation sub-system comprises:

distillation and condensation of the spent stream, the spent steam comprising a multi-component working fluid having a lower boiling point component and a higher boiling point component, mixing a lean stream having a reduced amount of lower boiling point component compared to higher boiling point component with a rich stream having a greater amount of lower boiling point component when compared to higher boiling point component, and mixing of a very lean stream with the spent working stream.

16. The method of claim 15, wherein the spent working stream passes in heat exchange relationship with an intermediate lean stream in the distillation condensation sub-stream prior to mixing with a very lean stream.

17. The method of claim 16, wherein the spent working stream is mixed with the very lean stream thereby forming an intermediate lean stream which passes through a low pressure condenser of the distillation condensation sub-system.

* * * * *

UNITED STATES PATENT AND TRADEMARK OFFICE

CERTIFICATE OF CORRECTION

PATENT NO. : 7,516,619 B2
APPLICATION NO. : 11/182603
DATED : April 14, 2009
INVENTOR(S) : Richard I. Pelletier It is certified that error appears in the above-identified patent and that said Letters Patent is hereby corrected as shown below:

Column 9
Line 33, claim no. 8, renumber to claim no. 10

Column 10
Line 1, claim no. 9, renumber to claim no. 11
Line 1, change “8” to --10--
Line 4, claim no. 10, renumber to claim no. 12
Line 4, change “9” to --11--
Line 6, claim no. 11, renumber to claim no. 8
Line 7, change “second” to --third--
Line 10, claim no. 12, renumber to claim no. 9

Signed and Sealed this

Second Day of June, 2009

John Doll

JOHN DOLL
*Acting Director of the United States Patent and Trademark Office*

UNITED STATES PATENT AND TRADEMARK OFFICE

CERTIFICATE OF CORRECTION

PATENT NO. : 7,516,619 B2
APPLICATION NO. : 11/182603
DATED : April 14, 2009
INVENTOR(S) : Richard I. Pelletier It is certified that error appears in the above-identified patent and that said Letters Patent is hereby corrected as shown below:

Title page illustrating a Figure, should be deleted, and replaced with the new Title page illustrating a Figure. (Attached)

Drawings

Sheet 1 of 2, Fig. 1, within reference 302, from point 162 to point 62, change the direction of the arrow to indicate the direction from point 162 toward point 62, as shown in the attached drawing replacement sheets. (See Attachment)

Sheet 1 of 2, Fig. 1, within reference 302, from point 36 to point 38, change the direction of the arrow to indicate the direction from point 36 toward point 38, as shown in the attached drawing replacement sheets. (See Attachment)

Drawings

Sheet 2 of 2, Fig. 2, within reference 302, from point 162 to point 62, change the direction of the arrow to indicate the direction from point 162 toward point 62, as shown in the attached drawing replacement sheets. (See Attachment)

Sheet 2 of 2, Fig. 2, within reference 302, from point 36 to point 38, change the direction of the arrow to indicate the direction from point 36 toward point 38, as shown in the attached drawing replacement sheets. (See Attachment)

Signed and Sealed this

Eighth Day of September, 2009

David J. Kappos

David J. Kappos
*Director of the United States Patent and Trademark Office*

(12) United States Patent
Pelletier

(10) Patent No.: US 7,516,619 B2
(45) Date of Patent: Apr. 14, 2009

(54) EFFICIENT CONVERSION OF HEAT TO USEFUL ENERGY

(75) Inventor: Richard I. Pelletier, Livermore, CA (US)

(73) Assignee: Recurrent Engineering, LLC, Kennett Square, PA (US)

( * ) Notice: Subject to any disclaimer, the term of this patent is extended or adjusted under 35 U.S.C. 154(b) by 422 days.

(21) Appl. No.: 11/182,603

(22) Filed: Jul. 14, 2005

(65) Prior Publication Data

US 2006/0010870 A1 Jan. 19, 2006

(51) Int. Cl.
*F01K 25/06* (2006.01)

(52) U.S. Cl. ..... 60/649; 60/651; 60/671

(58) Field of Classification Search ..... 60/649, 60/651, 671

See application file for complete search history.

(56) References Cited

U.S. PATENT DOCUMENTS

| | | | | | |
|---|---|---|---|---|---|
| 4,330,084 | A * | 5/1982 | Buchner et al. | ..... | 237/12.1 |
| 4,586,340 | A | 5/1986 | Kalina | | |
| 4,604,867 | A * | 8/1986 | Kalina | ..... | 60/653 |
| 4,763,480 | A | 8/1988 | Kalina | | |
| 4,982,568 | A | 1/1991 | Kalina | | |
| 5,095,708 | A | 3/1992 | Kalina | | |
| 5,132,076 | A * | 7/1992 | Corpora et al. | ..... | 376/310 |
| 5,291,530 | A * | 3/1994 | Impink et al. | ..... | 376/219 |
| 5,572,871 | A | 11/1996 | Kalina | | |
| 5,649,426 | A | 7/1997 | Kalina et al. | | |
| 5,950,433 | A * | 9/1999 | Kalina | ..... | 60/649 |
| 6,910,334 | B2 * | 6/2005 | Kalina | ..... | 60/651 |
| 6,968,690 | B2 * | 11/2005 | Kalina | ..... | 60/649 |

* cited by examiner

*Primary Examiner*—Hoang M Nguyen
(74) *Attorney, Agent, or Firm*—Workman Nydegger

(57) ABSTRACT

A heat transfer system includes a power sub-system configured to receive a heat source stream, and one or more heat exchangers configured to transfer heat from the heat source stream to a working stream. The working stream is ultimately heated to a point where it can be passed through one or more turbines, to generate power, while the heat source stream is cooled to a low temperature tail. A distillation condensation sub-system cools the spent stream to generate an intermediate stream and a working stream. The working stream can be variably heated by the intermediate stream so that it is at a sufficient temperature to make efficient use of the low temperature tail. The working stream is then heated by the low temperature tail, and subsequently passed on for use in the power sub-system.

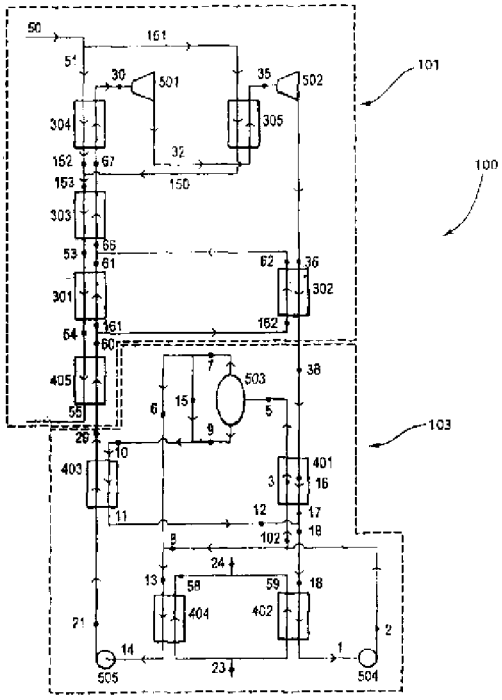

17 Claims, 2 Drawing Sheets